United States Patent [19]

Kemper

[11] Patent Number: 4,957,262

[45] Date of Patent: Sep. 18, 1990

[54] SPACE DEFINER FOR USE ON HORIZONTAL SURFACES

[75] Inventor: Alicia W. Kemper, Tallahassee, Fla.

[73] Assignee: Innovec, Inc., Tallahassee, Fla.

[21] Appl. No.: 228,943

[22] Filed: Aug. 5, 1988

[51] Int. Cl.[5] ..... A47B 47/04

[52] U.S. Cl. ..... 248/460

[58] Field of Search ..... 248/460, 441.1, 150, 248/176, 118; 108/27, 28, 43; 297/148, 153; 211/189; 264/344

[56] References Cited

U.S. PATENT DOCUMENTS

| | | | |
|---|---|---|---|
| 2,546,283 | 3/1951 | Webster | 248/444.1 X |
| 3,123,935 | 3/1964 | Williams | 108/28 X |
| 4,018,217 | 4/1977 | Evans | 248/118 X |
| 4,377,976 | 3/1983 | Porter | 108/28 |
| 4,679,509 | 7/1987 | Sampson, Jr. | 108/43 X |
| 4,807,928 | 2/1989 | Cone | 297/153 |

*Primary Examiner*—Ramon O. Ramirez

*Attorney, Agent, or Firm*—Arthur G. Yeager

[57] ABSTRACT

A spaced definer supportable on a table top to define an activity area comprising a perimeter wall enclosing an activity surface area on three sides and a fourth open side toward the user adapted to be placed along an edge of a table top. The perimeter wall has a plurality of interlocking portions and a plurality of attachable components for connecting optional accessory devices, such as subdividing walls, open top containers, and a framework to span the working surface for holding books or writing surfaces.

27 Claims, 4 Drawing Sheets

SPACE DEFINER FOR USE ON HORIZONTAL SURFACES

BACKGROUND OF THE INVENTION

This invention was the subject of Disclosure Document No. 183,014, filed Dec. 18, 1987, entitled "Space Definer".

This invention relates to a device in the form of a space definer to be used by persons with severe sensory, emotional, intellectual and/or physical impairments. Such persons, whether they be children or adults, normally spend some part of their daily life in vocational, rehabilitational, educational and/or recreational activities, as well as in activities which develop or maintain daily living or self-help skills. These activities generally require impaired persons to manipulate various objects, for example, parts for assembly in vocational activities, clay or sand in rehabilitational activities, books and writing instruments in educational activities, craft supplies and tools in recreational activities and eating and drinking implements in self-help activities. The space definer, in accord with this invention, functions as a lightweight retainer to keep materials and supplies within reach of a disabled person. The space definer provides such a person with greater control over his or her activity environment; enables such a person to work in proximity to others while maintaining activity environment control; and will allow such a person greater mobility and less site dependency due to the definer's ability to be collapsed and stored in a small, portable, unobtrusive carrying sheath.

It is an object of this invention to provide a work space definer for use on a horizontal surface of a table top or on a similar top detachably connected to a wheelchair. It is another object of this invention to provide a disassemblable table top work space definer with several optional accessory devices attachable to the definer. A specific object is to provide a waterproof cover sheet to overlie the space definer to protect the horizontal surface, for example, and to provide a water resistant area for eating and/or other activities or work involving scattering of materials, such as clay, and eating skill rehabilitation. A further object is the provision of components that can be used to subdivide the confined space of the definer. Additional objects are to provide a lightweight yet durable space definer for multi-use purposes that is easily used and inexpensively manufactured. Still other objects will become apparent from the more detailed description which follows.

BRIEF SUMMARY OF THE INVENTION

This invention relates to a space definer for use on a generally horizontal surface and includes a wall with two free ends to define an enclosed work space area open on one side thereof facing the user. The wall includes a forward wall portion and two side wall portions releasably attachable to each other to form a complete U-shaped wall. Each wall portion has an upper surface provided with one or more recesses and adapted to receive tongues on accessory devices optionally attachable to the space definer. Accessory devices include subdivider walls, containers, and a framework to support, for example, a book holder and a writing surface. In preferred embodiments the space definer is a generally semicircular wall made up of wall portions that interlock with each other by means of mortise and tenon joints, but may be of unitary construction, as by gluing and/or original fabrication, as by molding techniques.

BRIEF DESCRIPTION OF THE DRAWINGS

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
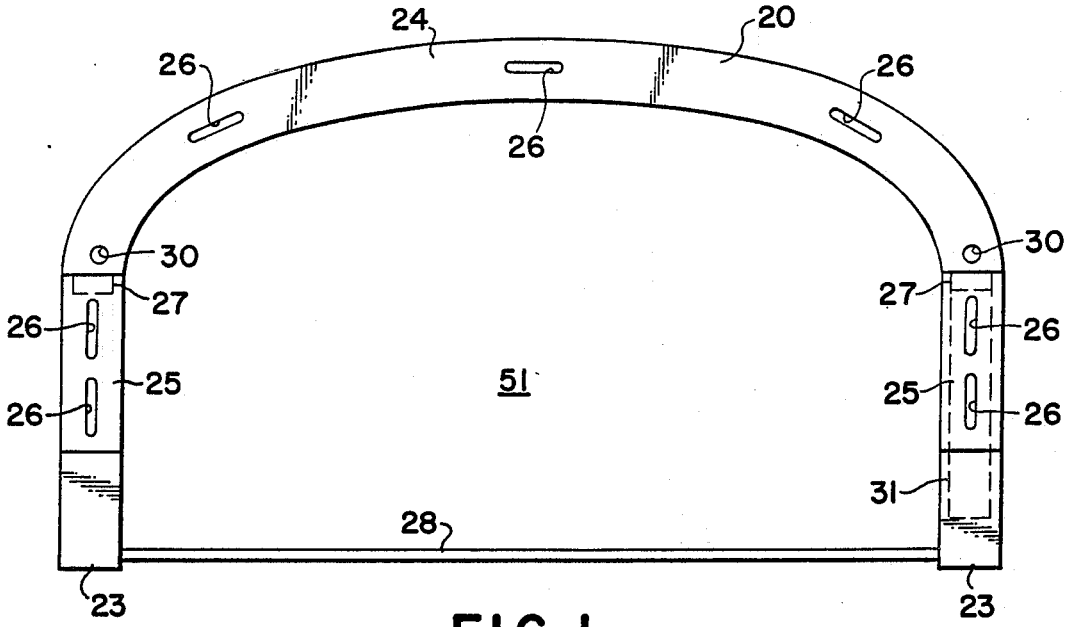
FIG. 1 is a top plan view of the space definer of this invention.
Figure 2:
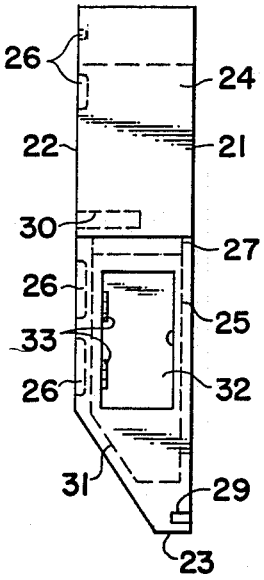
FIG. 2 is a side elevational view of the space definer of FIG. 1.
Figure 6:
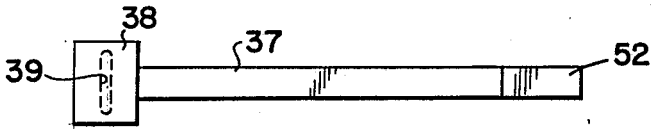
FIG. 6 is a top plan view of a second type of subdivider wall used with the space definer of this invention.
Figure 3:
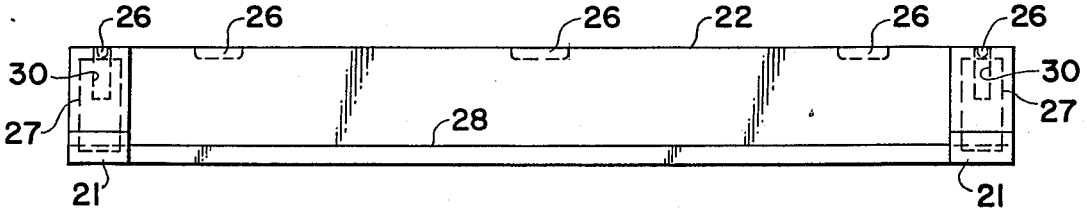
FIG. 3 is a front elevational view of the space definer of FIG. 1.
Figure 4:
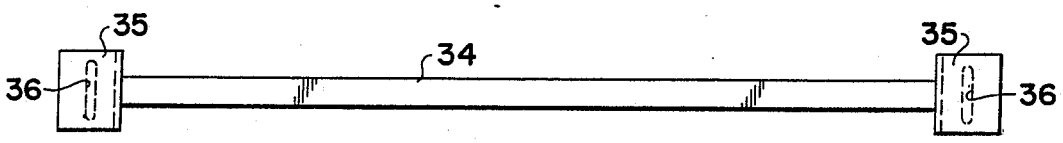
FIG. 4 is a top plan view of one type of subdivider wall used with the space definer of this invention.
Figure 5:
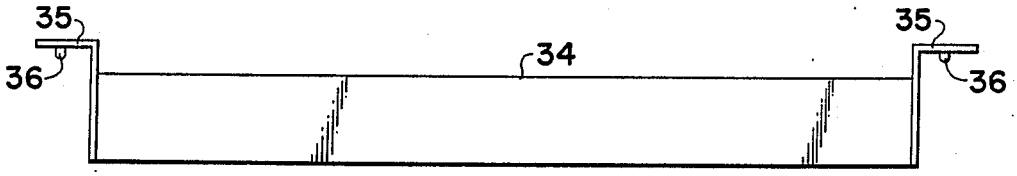
FIG. 5 is a front elevational view of the subdivider wall of FIG. 4.

The space definer of this invention may be understood more completely by reference to FIGS. 1–3 of the attached drawings.

Space definer 20 is a low wall which is intended to be placed on a generally horizontal surface, like a table, with wall ends 23 along the edge of the table, thereby forming a work space 51 enclosed on three sides by definer 20 and open on the front side between ends 23 for a person to have access to work space 51. In FIG. 1 work space 51 is generally an arcuate or semicircular surface defined by a generally semicircular wall 20 having outwardly and inwardly facing wall surfaces extending generally vertically. Other shapes than semicircular are equally feasible, e.g., semielliptical, rectangular (see FIG. 14), triangular, trapezoidal, parabolic, etc. Whatever shape is desired, it should be of a size that a person using that work space can easily reach all portions of it by hand or specialized implements which may be provided to such person. For this reason a generally semicircular workspace 51 is best suited to most situations.

Space definer 20 is preferably made up of a plurality (desirably three) of wall portions that can be disassembled for storage and portability and quickly assembled when needed for use. In FIG. 1 there is shown a central arcuate or curved portion 24 and two generally linear end portions 25 that are joined together by, for example, a mortise and tenon joint 27. Such a joint 27 may be held together by frictional forces or there may be a spring biased detent or other known means to hold such a joint together. Lower surface 21 of definer 20 lies in a single plane so that the device will lie flat on a table top and not move around easily. If desired, lower surface 21 may be covered with a high friction covering, such as a rubber coating or a spray coating of a tacky substance.

Upper surface 22 of space definer 20 contains a plurality of recesses 26 and 30 by means of which any of several accessory devices may be attached to wall portions 24 or 25. Recesses 26 are passageways in the form of slot recesses which receive correspondingly shaped slot tongues on the accessory device so as to releasably be attached to space definer 20. Passageway or recess 30 is a circular hole which is much deeper than slot recess 26 and is intended to receive a circular rod 50 used to support a framework or other device as will be described below in connection with FIG. 12. Wall portions 24 and 25 preferably are solid or tubular pieces of plastic, wood or metal. Plastics such as polyolefins, polyamides, polyacetals, polycarbonates, polyacrylics, phenol-formaldehyde materials, or urea-formaldehyde materials, are suitable. Metals that may be used include iron, steel, aluminum, titanium, copper, zinc, magnesium, and various alloys.

In one desired embodiment there may be an interior space in one or more of the hollow wall portions 24 and/or 25 which may be used for storage of tools, implements, protective sheet covers or the like. Such a compartment is shown in FIGS. 1 and 2 as space 31 which has an access door 32 which may be supported by hinges 33 or any other suitable manner. Preferably, the locations of the doors are adjacent the outer periphery so as not to interfere with the smooth unobstructed space 51, but if desirable may be located anywhere on the definer, i.e., on the upper surface 22 or lower surface 21. In any one space definer 20 there may be one such interior storage space 31 or several placed wherever desired in wall portions 24 or 25 generally between the inwardly facing and outwardly facing wall surfaces of the arcuate wall 20.

Figure 15:
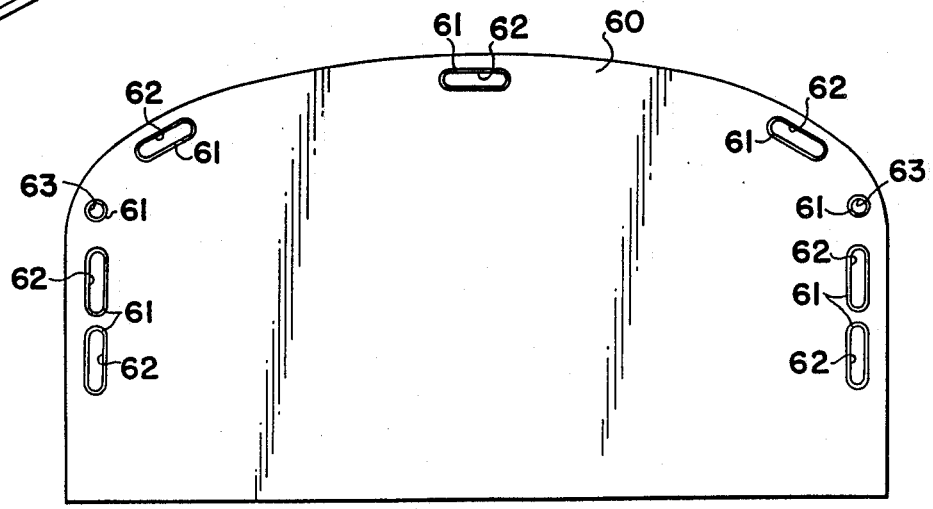
FIG. 15 is a plan view of an accessory waterproof sheet to be used with, the space definer of this invention.
Figure 16:
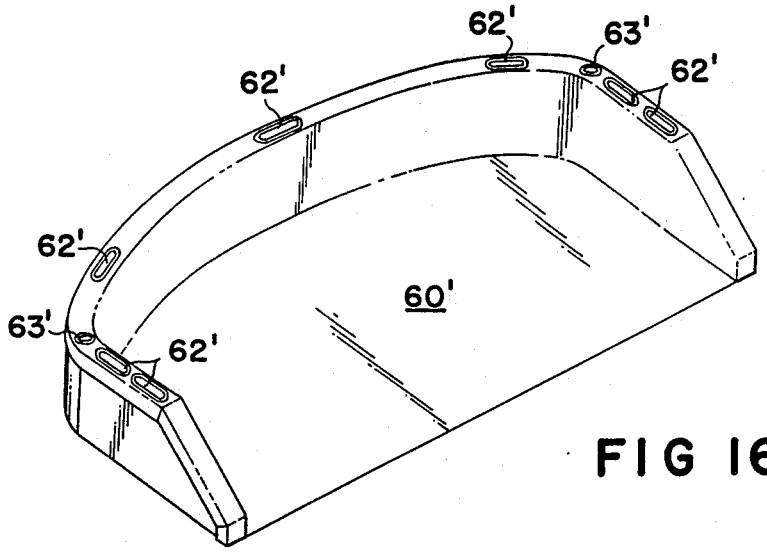
FIG. 16 is a perspective view of a contoured waterproof sheet usable with, the space definer.

It is intended that a waterproof sheet be used with the definer 20 which may be sufficiently large to overlie the definer with the sheet laying flat on the surface defined by work space 51. Small amounts of liquid and the like will be surrounded by the definer walls 24 and 25 and the barrier rod 28, hereinafter more fully described. The sheet 60 is illustrated in FIG. 15, and may be provided with reinforced portions 61 about slots 62 and openings 63 corresponding to recesses 26 and openings 30 so that the other accessory devices may be used at the same time as the sheet 60. It is to be noted that the sheet 60 does not fit tightly about definer walls 24 and 25 and there is sufficient extra material so that it drapes down the inside thereof and onto the horizontal surface defining work space 51. This is of particular importance where, for instance, eating skills are being developed or where occupational, therapeutic or educational requirements may include working with moisture-laden materials. Thus, the entire sheet 60 may be removed with the debris contained therein for disposal and thereafter the sheet is cleaned for reuse. The sheet 60 with the barrier rod 28 (hereinafter more fully described) in place forms a liner containment for liquids and the like. Another type of sheet 60′ is illustrated in FIG. 16 wherein the sheet 60′ is tailored or contoured to conform to the perimeter wall 24 and 25 so that it overlies the upper surface of such wall, overlies the inner generally vertical surface of such wall and partially overlies the outer generally vertical surface. Of course, the slots 62′ and openings 63′ would align with respective slots 26 and openings 30. A decided advantage is provided by the contoured sheet 60′ in that it would be more readily installed for use and render the installation of the accessory devices, subdivider walls, containers and even the framework 44 and holder 44′, easier. Also, the liner formed by the contoured sheet 60′ will remain in place better than the sheet 60 since it fits over and down the outer wall.

Among the accessory devices used with a space definer 20 is a barrier rod 28 which is releasably attachable to end wall portions 25 adjacent ends 23 in grooves 29. The lower surface of rod 28 also lies in the same plane as lower surface 21 of space definer 20. The height of the upper surface of barrier rod 28 above planar surface 21 is much less than the height of upper surface 22 of space definer 20, perhaps not greater than 25% of the height of upper surface 22. Barrier rod 28 is intended to serve the purpose of keeping materials in work space 51 from falling off the table. For example, there may be individual components in work space 51 which might inadvertently slide, roll or be forced off the table were it not for barrier rod 28. Vocational supplies, implements for therapy and educational procedures as well as other materials might be kept within work space 51 by barrier rod 28.

Figure 7:
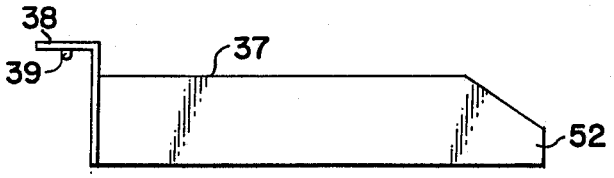
FIG. 7 is a side elevational view of the subdivider wall of FIG. 6.

In FIGS. 3–6 there are two types of subdivider walls that may be used to divide work space 51 into two or more smaller work spaces. Subdivider wall 34 is designed to span completely across work space 51 and be attached at each end thereof to a wall of space definer 20. Device 34 may be attached to each of linear side wall portions 25 to form a wall generally parallel to and spaced from barrier rod 28, as illustrated in FIG. 1. Horizontal leg of a flange 35 lies on upper surface 22 of wall portion 25 with a depending vertical leg or slot tongue 36 of flange 35 contiguous to the inside vertical wall of portion 25. Slot tongue 36 fits into any appropriate slot recess 26 on upper surface 22 of space definer 20. Subdivider wall 37 (FIGS. 6–7) is intended to be positioned generally angularly with respect to central wall portion 24. Subdivider wall 37 is attachable at only one end to space definer 20 by means of a flange 38 and a depending vertical leg in the form of a slot tongue 39 identical to corresponding parts 35 and 36 described above with respect to subdivider wall 34. Free end 52 of wall 37 will lie somewhere near a line joining ends 23 to each other, and will produce two work spaces which are fractions of work space 51 and which are both accessible from the open side of work space 51. Generally, subdivider wall 37 will be attached to any of slot recesses 26 in curved wall portion 24 (FIG. 1). It is to be noted that either wall 34 or 37 may have slot recesses therein identical to slot recesses 26 so that containers or the like as hereinafter more fully described, may be supported thereby.

Figure 8:
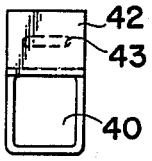
FIG. 8 is a top plan view of a container used with the space definer of this invention.
Figure 9:
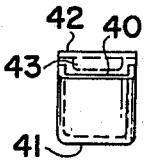
FIG. 9 is a front elevational view of the container of FIG. 8.
Figure 10:
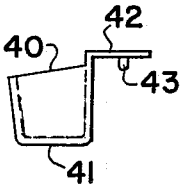
FIG. 10 is a side elevational view of the container of FIG. 8.

In FIGS. 8–10 there is shown a container having an open top 40, a closed bottom 41, an attaching flange 42 and a slot tongue 43. The latter two features, 42 and 43, are identical to the corresponding features on subdividing walls 34 and 37. The container of FIGS. 8–10 is intended to hold small implements, tools, or whatever may be placed therein. Typical uses would be to keep parts for assembly or materials for training or therapy.

Figure 11:
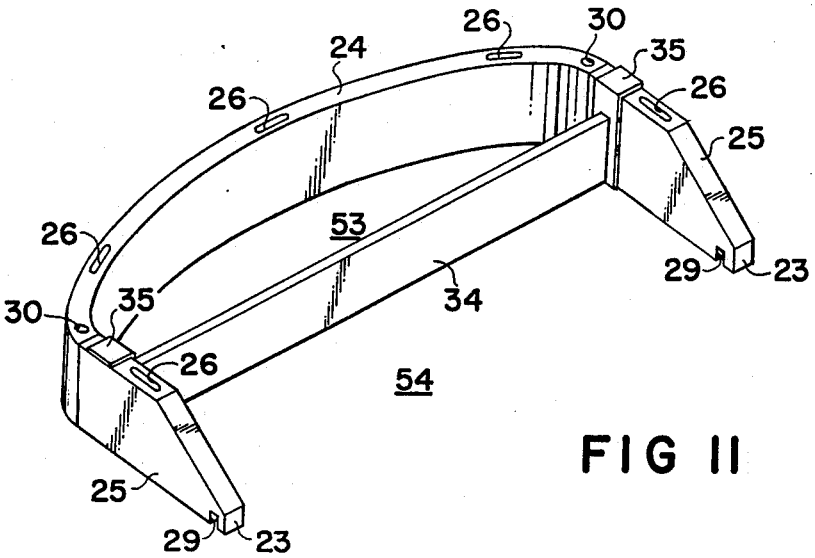
FIG. 11 is a perspective view of the space definer of this invention with one type of subdivider wall attached thereto.
Figure 12:
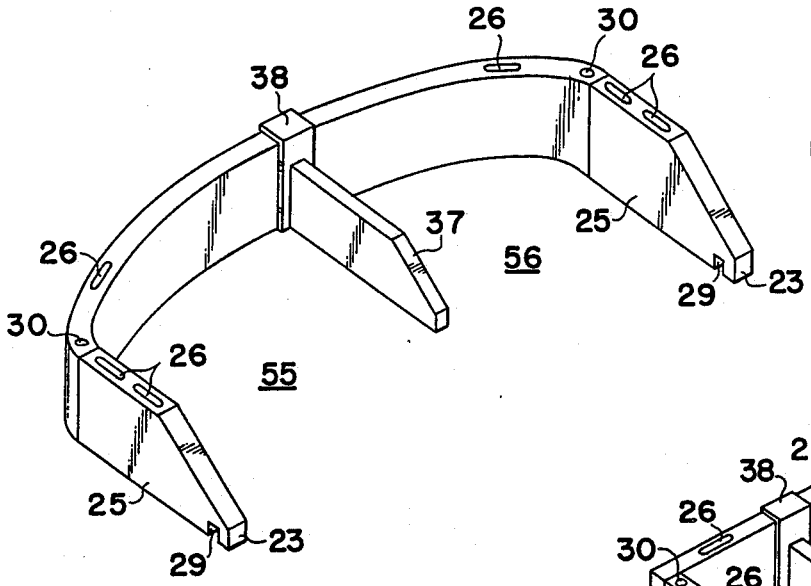
FIG. 12 is a perspective view of the space definer of this invention with a second type of subdivider wall attached thereto.
Figure 13:
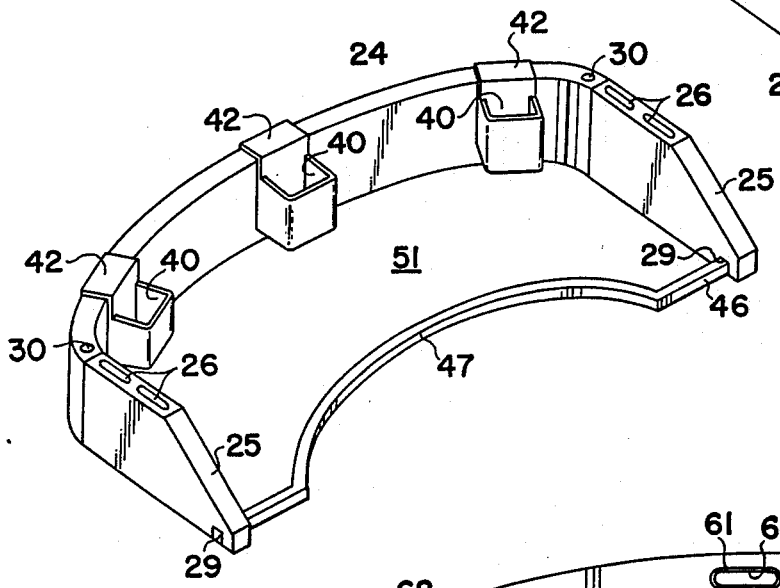
FIG. 13 is a perspective view of the space definer of this invention with three containers attached thereto.

FIGS. 11–13 show how the various accessory devices might be used with the space definer 20 of this invention. In FIG. 11 subdivider wall 34 has divided work space 51 into two smaller work spaces including sector 53 which is totally enclosed by curved wall portion 24, a fraction of linear wall portions 25, and subdividing wall 34, and sub-work space 54 having three sides formed by wall portions 25 and subdivider wall 34 and an open side between ends 23. In essence this accessory device merely condenses the work space 51 into the sub-work space 54, to render the space closer to and more accessible to the user.

In FIG. 12 space definer 20 is altered by subdivider wall 37 into two sub-work spaces 55 and 56 both of which are accessible from the open side between ends 23. It is to be understood that additional subdivider walls 37 may be employed adjacent the corners of the forward wall portion 24 to further subdivide the work space as readily understood by persons skilled in the art.

In FIG. 13 there is shown the use of the containers of FIGS. 8–10. Such containers may be used at any recess 26 for any purpose or holding implements, tools, or the like. There also is shown in FIG. 13 a modified version of barrier rod 28 of FIG. 1. Barrier rod 46 (FIG. 13) is the same cross sectional shape as rod 28 so it may be used interchangeably in grooves 29 in side wall portions 25. Barrier rod 46 has a curved portion 47 in the middle to accommodate a human torso therein. This permits a person in wheel chair that may have less mobility in his or her arms to be closer to the center of work space 51 and thus easier to reach all portions of work space 51 and space definer 20. This curved portion 47 conforms generally to cut-out portions of table tops specifically adapted for wheel chair users, that are well known to the art.

Figure 14:
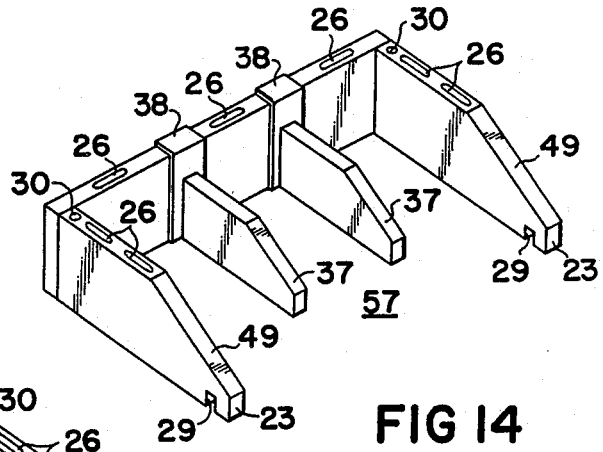
FIG. 14 is a perspective view of a rectangular space definer of this invention.

FIG. 14 shows an alternate embodiment for the space definer of this invention. The walls of the space definer comprise linear forward wall 48 and linear side walls 49 to define a rectangular work space 57. The same recess means 26 and 30 for attaching accessory devices are employed and the same grooves 29 are used for positioning of a barrier rod 28 or 46. One or more subdivider walls 37 may be employed to subdivide the space into two spaces when one subdivider wall 37 is employed, three spaces for two walls 37, etc.

FIGS. 15 and 16 depict the previously described planar sheet 60 and contoured sheet 60' to be used with the space definer 20 in accord with this invention. It is to be understood that such waterproof sheets may be made to be used with and to conform to the alternate space definer shown in FIG. 14 as would be evident to those having ordinary skill in the art.

Figure 17:
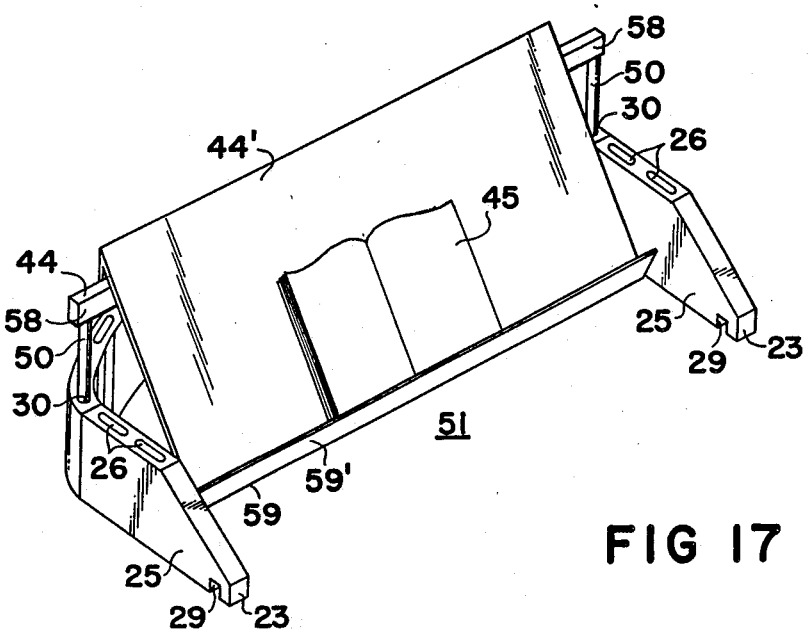
FIG. 17 is a perspective view of the space definer with an accessory spanning framework attached thereto.

As shown in FIG. 17 a framework 44 is supported by a pair of spaced rods 50 with a cross-piece 58 so as to span work space 51 for any of several purposes, such as supporting a work surface or holder 44' on which a book 45 may rest. Instead of a book, there may be a chalk board, a writing tablet, a frame for a painting canvas, etc. Framework rods 50 are telescopically seated in holes 30 (see also FIG. 1), which may be circular, square, triangular, or other shape. Shapes other than circular may be desirable if a framework is supported by only one rod 50 which could not turn in a noncircular hole 30. While holder 44' is shown as supporting a book 45, it may be used as a writing surface upon which ink marking pens may be used, the ink being removable by a wiping cloth or the like. The bottom edge 59 of holder 44' rests upon the table top upon which the definer is placed and has an upturned lip 59'. The bottom portion, including edge 59 and lip 59', may be bifurcated to accommodate subdivider wall 37, if it were desired to use wall 37 with the holder 44'. Such bifurcation would provide some overall stability to the holder 44' and its framework 44.

The preferred embodiment disclosed herein is fabricated of three components which are detachably secured to each other. However, these components may be permanently secured together or otherwise integrally constructed. The preferred embodiment likewise is hollow so as to minimize the weight thereof while providing storage space therein. The definer may be made solid and/or thinner without pockets, for example, in an inverted U-section, if found to be desirable.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what it is desired to secure by Letters Patent of the United States is:

1. A space definer comprising a wall with two free ends and adapted to lie on a generally horizontal flat supporting surface to define an enclosed activity area open on one side thereof facing a user, said wall including a forward wall portion and two side wall portions connected to each other to form said wall in a generally U-form, said U-form wall having an inwardly facing surface and an outwardly facing surface, at least one of said wall portions having a storage space located between said wall surfaces for accessories to be used with said space definer.

2. The space definer of claim 1 wherein said enclosed activity area is generally semicircular.

3. The space definer of claim 1 wherein said enclosed activity area is generally rectangular.

4. The space definer of claim 1 wherein a plurality of said wall portions includes a means for releasably connecting accessory devices to said wall which includes a plurality of spaced recesses in said wall portions into which corresponding tongues of accessory devices are insertable.

5. The space definer of claim 4 which includes a linear wall having spaced tongues attachable to respective said recesses to divide the area within said space definer into one enclosed space and a generally rectangular open area adjacent a user thereof, said linear wall being generally parallel with a line connecting said two free ends.

6. The space definer of claim 4 which includes a linear wall having a free end and an opposite end with a tongue extending therefrom, said linear wall being attachable by said tongue thereon to said forward wall portion to divide said activity area into two work space portions both of which are open on said open side of said activity area.

7. The space definer of claim 1 further comprising an open top container and means for releasably attaching said container to said wall with said container being located in said activity area.

8. The space definer of claim 1 further comprising an elongated barrier rod releasably attachable at each end thereof to each of said side wall portions adjacent respective said two free ends, said rod being supportable by a generally horizontal flat surface and having a height thereabove of no more than about 25% of the height of said curved wall.

9. The space definer of claim 1 further comprising means for forming a waterproof containment for liquids in said enclosed activity area.

10. The space definer of claim 1 which additionally includes two widely spaced passageways adapted to receive complemental legs of a framework extending across said activity area, said framework being adapted to position a generally slanted work surface from said framework to a generally horizontal flat surface onto which said definer is placed.

11. The space definer of claim 10 wherein said slanted work surface includes a flange along its lower edge adapted to support a book.

12. The space definer of claim 10 wherein said slanted work surface is a writing surface.

13. The space definer of claim 1 wherein at least another of said wall portions includes a storage space located between said wall surface.

14. A space definer comprising a wall with two free ends and adapted to lie on a generally horizontal flat supporting surface to define an enclosed activity area open on one side thereof facing a user, said wall including a forward wall portion and two side wall portions connected to each other to form said wall in a generally U-form, at least one of said wall portions having a storage space for accessories to be used with said space definer, at least one of said wall portions having a substantial hollow interior space, and door means through said wall portion for accessing said interior space.

15. An activity space definer adapted to be on a table or the like and comprising a perimeter wall having a lower planar surface and two free ends between which is formed an activity space inside said wall, accessory devices including subdivider walls adapted to be releasably attached to said perimeter wall to subdivide said activity space into two or more sub-activity spaces within said perimeter wall, and open top containers releasably attachable to said perimeter wall.

16. The space definer of claim 15 wherein said perimeter wall has an upper surface adapted to support said accessory devices.

17. The space definer of claim 15 wherein said perimeter wall includes a plurality of wall portions and means for detachably securing said wall portions together to form a generally U-shaped said curved perimeter wall.

18. The space definer of claim 15 wherein said subdivider walls include a selectable first wall attachable at each end thereof to said perimeter wall to divide said activity space into one sub-activity space which is totally enclosed by said perimeter wall and said first wall and another sub-activity space which is open between said two free ends, and a selectable second wall attachable at one end thereof to said perimeter wall and having the other end unattached to divide said activity space into two sub-activity spaces, both of which are open on one side between one of said free ends of said perimeter wall and said unattached end of said second wall.

19. The space definer of claim 15 wherein said perimeter wall includes a front wall portion having two ends and two linear end wall portions attachable respectively to said ends of said front wall portion, and a barrier rod spanning between said ends of said linear end wall portions.

20. The space definer of claim 19 further comprising a hollow interior in at least one of said wall portions with a covered access opening to said hollow interior, said hollow interior forming an enclosed storage space for optional accessories to be used with said space definer.

21. The space definer of claim 15 wherein said perimeter wall includes at least one hollow interior forming an enclosed storage space for optional accessories to be used with said space definer, said perimeter wall having an access opening communicating with said storage space and an openable door covering said opening.

22. The space definer of claim 15 further comprising a framework releasably attachable to said perimeter wall adapted to hold reading and writing materials in an accessible substantially slanted position in front of a user of said definer.

23. The space definer of claim 15 which additionally comprises a low barrier wall connecting said two free ends of said perimeter wall, said barrier wall having a lower surface which is coplanar with said lower surface of said perimeter wall, and an upper surface which lies at an elevation above said lower surface of not more than 25% of the elevation of said upper surface of said perimeter wall.

24. The space definer of claim 23 wherein said barrier wall includes an arcuate portion medially of the ends thereof and extending toward said perimeter and adapted to partially encircle a human torso to permit easier access to all portions of said work space.

25. The space definer of claim 15 further comprising a barrier rod spanning between said two free ends, a waterproof sheet overlying said perimeter wall and barrier rod to form a liner containment for liquids and the like.

26. The space definer of claim 25 wherein said perimeter wall has spaced recesses to accommodate complemental tongues on said accessory devices, said sheet having spaced openings therethrough in general alignment with said recesses when said sheet is positioned in its location over said perimeter wall whereby said tongues may be respectively positioned through said openings and into respective said recesses.

27. The spaced definer of claim 25 wherein said sheet is contoured and substantially to said perimeter wall to conform to its upper surf and to overlie its inner generally upright surface and to y overlie its outer generally upright surface.

* * * * *